United States Patent [19]

Moe

[11] 4,101,230

[45] Jul. 18, 1978

[54] JOINT FOR TRUSSES

[76] Inventor: Per H. Moe, Kristian Brenners vei 56c, 3000 Drammen, Norway

[21] Appl. No.: 667,956

[22] Filed: Mar. 18, 1976

[30] Foreign Application Priority Data

Mar. 20, 1975 [NO] Norway ..... 750967

[51] Int. Cl.[2] ..... F16B 7/00

[52] U.S. Cl. ..... 403/171; 61/87; 403/217; 403/272

[58] Field of Search ..... 403/169, 170, 171, 172, 403/173, 174, 175, 176, 177, 178, 217, 271, 272; 52/758 B, 758 R; 61/46.5

[56] References Cited

U.S. PATENT DOCUMENTS

| | | | |
|---|---|---|---|
| 2,955,353 | 10/1960 | Gross | 52/758 B |
| 3,596,950 | 8/1971 | Wipkink | 52/758 R |
| 3,632,147 | 1/1972 | Finger | 403/176 |
| 3,914,060 | 10/1975 | Miller | 403/171 |

FOREIGN PATENT DOCUMENTS

| | | | |
|---|---|---|---|
| 1,287,569 | 2/1962 | France | 403/178 |

*Primary Examiner*—Andrew V. Kundrat
*Attorney, Agent, or Firm*—Howson and Howson

[57] ABSTRACT

The present invention relates to a joint for trusses, preferably trusses where the force transmitting members mainly consist of tubes having relatively large diameters.

5 Claims, 3 Drawing Figures

JOINT FOR TRUSSES

BACKGROUND OF THE INVENTION

Such trusses are for instance used to a large extent both for fixed and floating platforms for drilling for, and production of, oil on the sea floor. For some types of platforms the entire supporting structure consists of such trusses, and for other types the truss may form part of the platform deck and/or a transition between the platform deck and its supporting structure.

As mentioned above, the members of such trusses consist mainly of tubes which usually have considerable diameters, often of an order of magnitude of 1 m. In addition, tubular supporting columns of even greater diameter are often used.

The members of the truss, often consisting of steel tube, are attached to joints at their ends, and this occurs according to conventional methods by welding the ends of the tubes together and/or to tubes running continuously through the joint.

These conventional methods for connecting the tubes in joints give rise to very considerable problems both with regard to the performance of the fabrication work and with respect to the theoretical calculations of the strength and probable life of the truss. A further element of uncertainty of considerable magnitude is due to the anisotropic properties of the tubular material.

Since most of the tubes which meet in a joint run at an angle with respect to each other, complicated adjustment work must be performed before the tubes can be welded together. The welding is in itself very difficult and time consuming due to large material thickness, narrow angles and difficult access. In most cases, the welding work can only be performed from the outside and, due to the access problems, the control of the welds must be done as the work progresses, thus braking up the welding work. The welding work is in itself so difficult that each welder must qualify especially for such tube connections. Stress relieving locally of the welds is very difficult due to the geometry of the joints and normalizing is not possible.

When tubes are welded together in a joint, it is not possible to avoid forces and stresses occuring transversely of the longitudinal direction of the tubes. Since the tubes consist of rolled plate material, this means that the material is loaded perpendicularly to the rolling plane, and in this direction the properties of the material are poorer than in the rolling plane, i.e., in other words, the material is anisotropic. This is among other things due to the fact that relatively soft impurities, which have a tendency to collect at the grain boundaries, are rolled out to flakes having poor strength and fatique characteristics. When stress occurs transversely of the rolling plane, cracks and laminar tearing easily occur in the rolling plane. This cracking may occur during the welding, or it may occur delayed several years after the structure has been put in service and may thereby escape the quality control. Such delayed cracking is considered very dangerous for the function of the joint.

Calculation of a conventional joint with respect to material thickness, fatigue etc. is extremely difficult even using modern computer techniques, and an exact calculation of every joint in a structure is practically an impossible task. In a welded connection between tubes, an extremely complicated stress distribution will occur due to the difference in tube stiffness in the axial and radial directions, and there may occur very large stress concentrations which can not be predicted with any degree of certainty. Reinforcing plates, transitions, acute angles etc. give rise to unpredictable stress concentration factors which further contribute to the uncertainty of the theoretical result.

The result is that simplified methods must be used, and the simplest of these is based on empirical calculation methods assuming that forces from subordinate members are taken up as membrane stresses in the main members. For this type of joint it is not practically possible to determine more than the minimum rupture load without regard to fatigue due to variations in diameters, thicknesses, angles, materials etc.

For larger joints it will be necessary to use internal and external reinforcing plates which transmit the member forces without the aid of membrane forces. The calculations must also here be based on the minimum rupture load for static loading where advantage is taken of the yield properties of the steel. Calculation of local stress peaks is not practically possible, and instead, local structural details are fabricated in a manner shown by practical experience to be advantageous for the purpose of avoiding fatigue, i.e., rounded corners, ground welds, no sharp edges etc.

Conventional calculation of trusses assumes that the members are movably supported in hypothetical joints. Tubular cross sections have relatively high moments of inertia, however, and new calculations by means of computer show considerable additional stresses due to the mutual fixing of the members. These additional stresses increase for the known tube joints because reinforcements make the joints stiffer and the degree of fixing of the members higher. It should be evident that calculation of such additional stresses for all joints in a truss would be quite a formidable task.

Calculation of stresses necessitates knowledge of both the existing forces and the surfaces over which these are distributed. Some tube joints are so complicated that it is necessary to use special computer programs in order to calculate the cross-sectional areas. Model tests will to a certain extent be able to contribute to reducing the uncertainty surrounding the stresses calculated, but here one will encounter the difficulty that making models to a scale sufficiently small to be suitable for the loads that can be obtained in a laboratory becomes very complicated.

The conventional tube joint thus becomes a very expensive construction because it must be over-dimensioned due to the uncertain stress calculations, because expensive materials having reduced tendency of laminar tearing must be used, and because time consuming and difficult welding procedures must be employed. The purpose of the invention is to provide a joint for trusses of the type mentioned in the introduction, for which the above-mentioned drawbacks and deficiencies are eliminated or greatly reduced.

SUMMARY OF THE INVENTION

The objects of the present invention are obtained by providing a joint consisting of a unitary piece to which the members are welded individually. According to further features of the invention, transition pieces are interposed between the joint and the members, the purpose of the transition pieces being to give a gradual transition between the cross section of the tube and the corresponding point of attachment on the joint. Furthermore, both the transition pieces and the joint may consist of isotropic material, for instance forged steel.

Other features of the invention will be apparent from the claims.

The advantages of a joint according to the invention is among other things that it can be given a relatively simple form where the stress distribution can be calculated with great certainty and where stress concentration factors are controllable. Since the joint may be made from isotropic material, its strength can be utilized effectively without danger of unpredictable form of failure like for instance laminar tearing. Furthermore, membrane stresses can be avoided.

Due to the compact design the cross-sectional areas will have much smaller moments of inertia. This will greatly reduce the fixing moments, making the joint behave much more like an ideal joint. Simplified geometry and analysis will make model tests with regard to fatigue, for instance in 1:10 scale, both simpler and cheaper. All cross-sectional areas are simple, thus contributing to simplified analysis.

The fabrication of the joint is also greatly simplified, both with respect to fabrication of the joint piece itself and to the connection of the members to the piece. The joint piece may for instance be made of a piece of forged steel which without difficulty may be cut to its final shape. The welding procedures for connecting the members and the joint are few and simple, and one can to a large extent use electro-slag welding. Control of the welds takes place on the finished product, and these have small surface areas for any finishing work. Also, they may easily be stress relieved or normalized. The joint according to the invention thus involves appreciably lower fabricating costs while concurrently giving substantially greater safety.

The invention will be described in further detail in connection with the embodiment shown as an example in the drawings.

Figure 1:
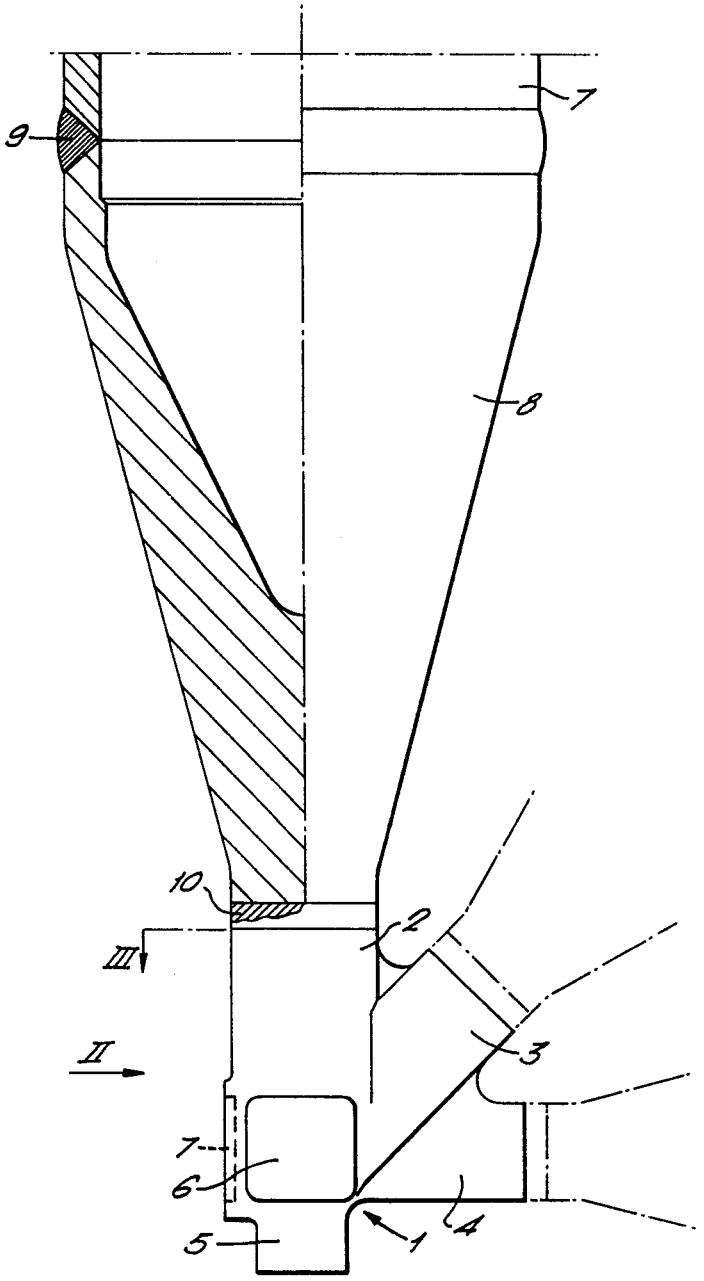
FIG. 1 shows a joint piece according to the invention to which a truss member is connected.

The joint piece 1 shown in FIG. 1 is made of forged steel which has been cut to its final shape. The joint piece has a number of arms or protrusions 2, 3, 4, 5, 6 to each of which is connected a truss member. The centre lines of the arms all meet at the centre of the joint, and the outer end of each arm is terminated in a plane surface perpendicular to the axis of the arm.

A tubular truss member 7 is connected to the arm 2 via a transition piece 8. The member 7 is welded to the transition piece 8 at 9, and the transition piece is welded to the arm 2 at 10. The weld 10 can be made by electroslag welding, i.e., by partially surrounding the weld groove by a water-cooled jacket containing the weld material when it is poored into the weld groove. Dotted lines indicate transition pieces and welds connected to the arms 3 and 4. The transition piece 8 is preferably also made of an isotropic material like for instance forged steel.

Figure 2:
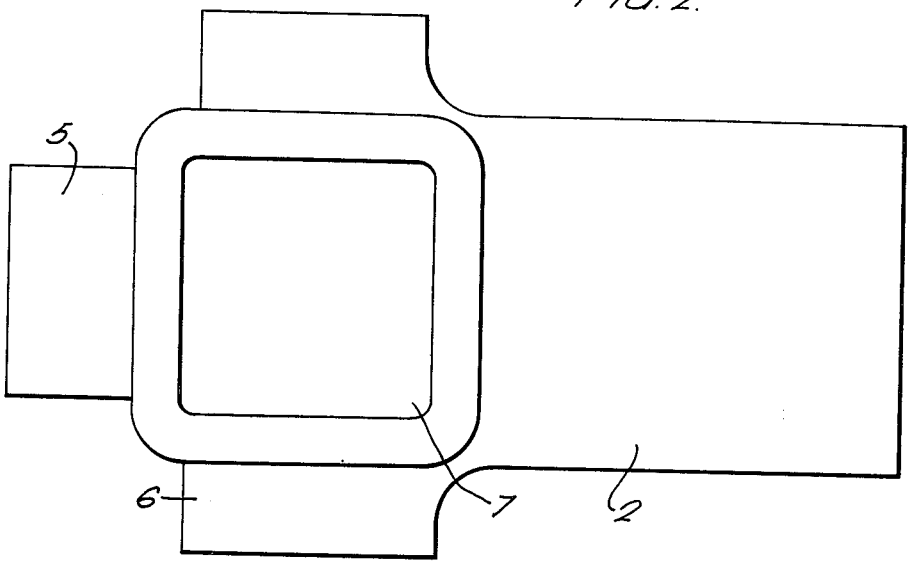
FIG. 2 shows the joint piece in FIG. 1 viewed in the direction of the arrow II.
Figure 3:
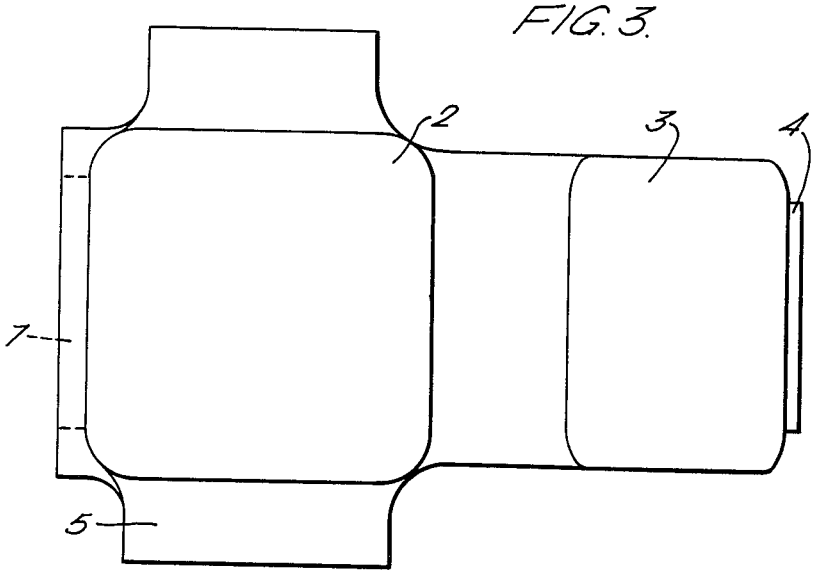
FIG. 3 shows the joint piece in FIG. 1 viewed in direction of the arrow III.

On the left side of the joint in FIG. 1 and 3 dotted lines indicate a recess 7 which also is shown in plan view in FIG. 2. This recess 7 co-operates with a supporting point on the structure on which the truss rests or which the truss supports.

Even though the joint in the embodiment shown is made from a piece of forged steel, the joint may be made by joining, preferably by welding, several pieces together if this should turn out to be more suitable. Furthermore, no limitation is intended by the arms in the shown embodiment having approximately square cross sections since the favourable properties of the joint may be maintained also for other cross section forms.

I claim:

1. A joint structure for joining the ends of large-diameter tubular truss members, comprising:

a unitary joining member of solid construction, having protruding stub arms each adapted to be connected to one end of one of said truss members and each of a circumference small compared with that of said corresponding truss end;

said joining member being substantially homogeneous and having substantially isotropic ultimate strength characteristics, whereby the stress point at which it loses its integrity is substantially the same for all directions of applied stress; and transition pieces each welded at one end to one of said stub arms and each weldable at its other end to the corresponding one of said truss members, for supportively connecting said stub arms to said truss members;

each of said transition pieces having a first portion of substantially solid construction in cross-section adjacent the stub arm to which it is welded, and each having a second portion toward its other remote end which is tubular to substantially match the said end of the corresponding truss member for easy welding thereto;

each of said transition pieces having an outer circumference which increases along the direction from said solid first portion thereof toward said tubular second portion thereof, and having a wall thickness in said tubular second portion which gradually decreases by tapering downwardly from a position adjacent said first portion thereof toward said other remote end thereof;

whereby there is provided a greater flexibility in and adjacent said stub arms than in said truss members, thereby providing a flexible connection for said truss members which is capable of relieving bending stresses in said truss members, while rendering more reliably calculable the load-bearing characteristics of an assembly of truss members joined by said joint structure.

2. The joint structure of claim 1, wherein said unitary joining member is of forged steel.

3. The joint structure of claim 1, wherein the longitudinal axes of all of said stub arms meet at substantially a single point in said unitary joining member.

4. The joint structure of claim 1, wherein said transition pieces are made of a material which has substantially isotropic ultimate strength characteristics.

5. The joint structure of claim 4, wherein said transition pieces are made of forged steel.

* * * * *